US010497338B2

(12) United States Patent
Xi et al.

(10) Patent No.: US 10,497,338 B2
(45) Date of Patent: Dec. 3, 2019

(54) DISPLAY DEVICE AND DRIVING METHOD

(71) Applicant: AU OPTRONICS CORPORATION, Hsin-chu (TW)

(72) Inventors: Peng-Bo Xi, Hsin-chu (TW); Sung-Yu Su, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 52 days.

(21) Appl. No.: 15/925,951

(22) Filed: Mar. 20, 2018

(65) Prior Publication Data

US 2019/0073985 A1 Mar. 7, 2019

(30) Foreign Application Priority Data

Sep. 5, 2017 (TW) ..... 106130331 A

(51) Int. Cl.
*G09G 5/10* (2006.01)

(52) U.S. Cl.
CPC ..... *G09G 5/10* (2013.01)

(58) Field of Classification Search
CPC ..... G09G 3/20; G09G 5/10
See application file for complete search history.

(56) References Cited

U.S. PATENT DOCUMENTS

| | | | |
|---|---|---|---|
| 8,633,884 | B2 | 1/2014 | Baek et al. |
| 2004/0246278 | A1 | 12/2004 | Elliott |
| 2007/0008263 | A1 | 1/2007 | Kim |
| 2007/0091044 | A1 | 4/2007 | Park et al. |
| 2010/0156771 | A1* | 6/2010 | Lee et al. ..... 345/87 |

OTHER PUBLICATIONS

Office Action issued by (TIPO) Intellectual Property Office, Ministry of Economic Affairs, R. O. C. on Mar. 12, 2018 for Application No. 106130331, Taiwan.

* cited by examiner

*Primary Examiner* — Nelson M Rosario
(74) *Attorney, Agent, or Firm* — Tim Tingkang Xia, Esq.; Locke Lord LLP

(57) ABSTRACT

A display device includes a plurality of sub pixels, a first data line, and a second data line. The first data line is configured to provide a first pixel voltage to a first sub pixel of the sub pixels, and the first sub pixel has a first color. The second data line is configured to provide a second pixel voltage to a second sub pixel of the sub pixels, and the second sub pixel has the first color. The first data line and the second data line are disposed between two adjacent sub pixels of the sub pixels. Polarities of the first pixel voltage and the second pixel voltage are different.

7 Claims, 7 Drawing Sheets

DISPLAY DEVICE AND DRIVING METHOD

CROSS-REFERENCE TO RELATED PATENT APPLICATION

This non-provisional application claims priority to and the benefit of, pursuant to 35 U.S.C. § 119(a), patent application Serial No. 106130331 filed in Taiwan on Sep. 5, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

Content of the embodiments in the present disclosure relates to a display device and a driving method.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A display device has been applied to many electronic devices. In an existing display technology, pixels and data lines may be configured in various arrangement manners. However, some configurations cause different pixel voltages to mutually affect one another. This is disadvantageous to display effects of a display panel.

SUMMARY

An embodiment of the present disclosure relates to a display device. The display device comprises a plurality of sub pixels, a first data line, and a second data line. The first data line is configured to provide a first pixel voltage to a first sub pixel of the sub pixels, and the first sub pixel has a first color. The second data line is configured to provide a second pixel voltage to a second sub pixel of the sub pixels, and the second sub pixel has the first color. The first data line and the second data line are disposed between two adjacent sub pixels of the sub pixels. The polarities of the first pixel voltage and the second pixel voltage are different.

An embodiment of the present disclosure relates to a driving method for a display device. The driving method comprises: providing, by using a first data line, a first pixel voltage to a first sub pixel of a plurality of sub pixels of the display device, the first sub pixel having a first color; and providing, by using a second data line, a second pixel voltage to a second sub pixel of the sub pixels of the display device, the second sub pixel having the first color. The first data line and the second data line are disposed between two adjacent sub pixels of the sub pixels. The polarities of the first pixel voltage and the second pixel voltage are different.

Based on the above, by means of any one of the foregoing embodiments, it can be avoided that the first pixel voltage on the first data line is coupled by the second pixel voltage on the second data line to an abnormal level.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

To make the aforementioned and other objectives, features, advantages and embodiments of the present disclosure more comprehensible, the accompanying drawings are described as follows.

DETAILED DESCRIPTION

Figure 1:
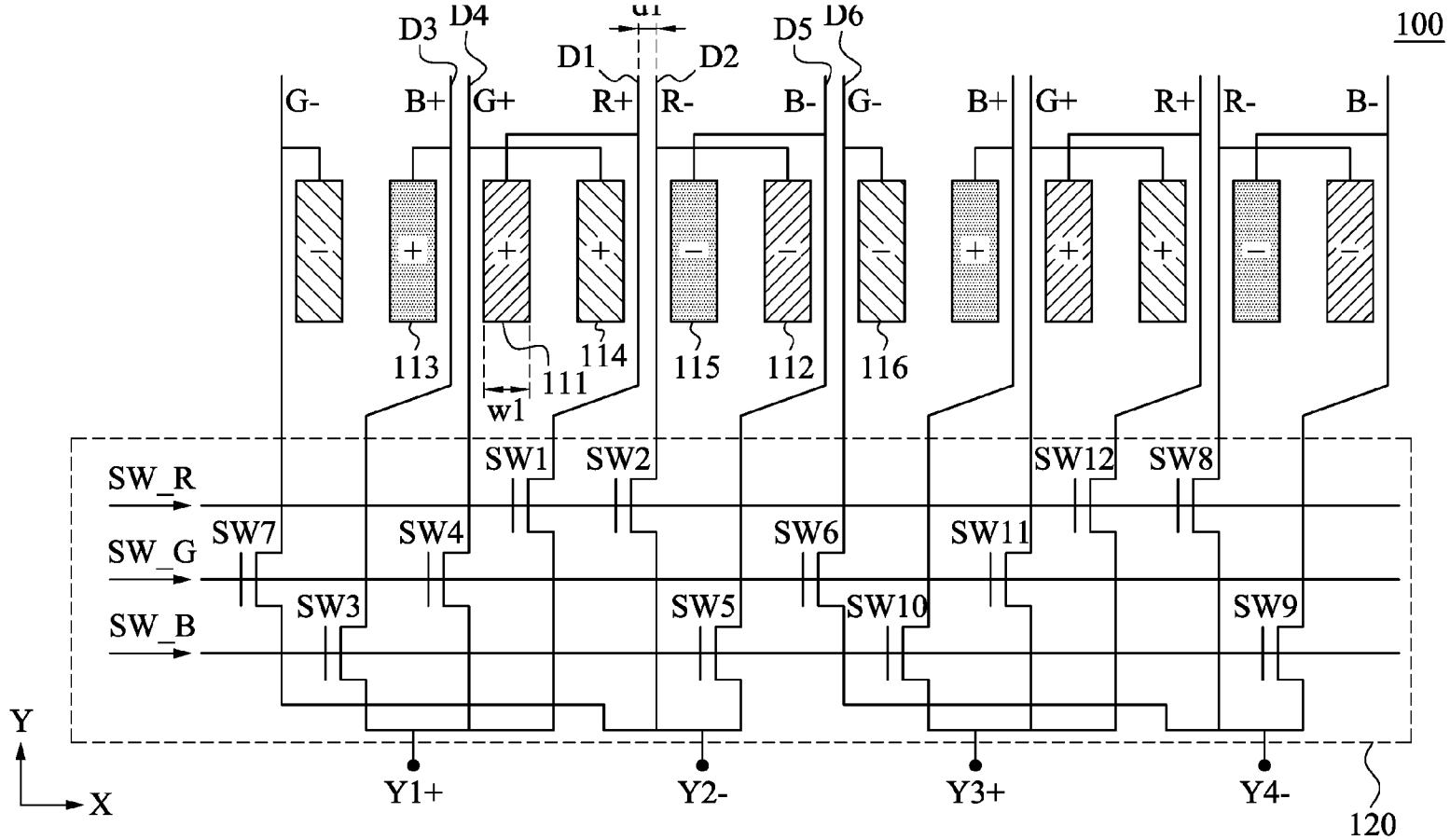
FIG. 1 is a part of a schematic diagram of a display device according to some embodiments of the present disclosure.

Embodiments accompanied with figures are described in detail below. However, the embodiments provided are not intended to limit the scope of the present disclosure. The description of structures and operations are not intended to limit the order of execution. Any structure formed by recombining elements shall fall within the scope of the present disclosure as long as an equivalent apparatus can be generated. In addition, the figures are merely provided for the purpose of description, but are not drawn to scale. Same or similar elements are denoted by same reference numerals in the following description to facilitate understanding.

Unless otherwise specified, each term used in the whole specification and the claims usually has a normal meaning that the term has when used in this field, in content of the present disclosure, and in special content.

Refer to FIG. 1. FIG. 1 is a part of a schematic diagram of a display device 100 according to some embodiments of the present disclosure. For ease of understanding, FIG. 1 shows only some sub pixels, some data lines, and some switches of the display device 100. That is, a quantity of sub pixels, a quantity of data lines, and a quantity of switches in the display device 100 are not limited to FIG. 1.

Descriptions are provided below specific to sub pixels 111 to 116 and relevant content. In some embodiments, a first sub pixel 111 and a second sub pixel 112 have a first color. A third sub pixel 113 and a fifth sub pixel 115 have a second color. A fourth sub pixel 114 and a sixth sub pixel 116 have a third color. Using FIG. 1 as an example, the first color is red, the second color is blue, and the third color is green. Content of the present disclosure is not limited to the foregoing content.

In some embodiments, a first data line D1 is coupled to the first sub pixel 111, a second data line D2 is coupled to the second sub pixel 112, a third data line D3 is coupled to the third sub pixel 113, a fourth data line D4 is coupled to the fourth sub pixel 114, a fifth data line D5 is coupled to the fifth sub pixel 115, and a sixth data line D6 is coupled to the sixth sub pixel 116.

In some embodiments, the first data line D1 and the second data line D2 are disposed between the fourth sub pixel 114 and the fifth sub pixel 115, and the fourth sub pixel 114 is adjacent to the fifth sub pixel 115. In this way, the first data line D1 and the second data line D2 form a near line configuration. In some embodiments, the third data line D3 and the fourth data line D4 are disposed between the third sub pixel 113 and the first sub pixel 111, and the third sub pixel 113 is adjacent to the first sub pixel 111. In this way, the third data line D3 and the fourth data line D4 form a near line configuration. In some embodiments, the fifth data line D5 and the sixth data line D6 are disposed between the second sub pixel 112 and the sixth sub pixel 116, and the second sub pixel 112 is adjacent to the sixth sub pixel 116. In this way, the fifth data line D5 and the sixth data line D6 form a near line configuration.

In some embodiments, a distance between any two data lines is smaller than a pixel width of any sub pixel. For example, a distance d1 between the first data line D1 and the second data line D2 is smaller than a pixel width w1 of the first sub pixel 111. In some embodiments, pixel widths of all sub pixels are the same. In some other embodiments, pixel widths of all sub pixels are different or partially different.

In some embodiments, the first data line D1 is configured to provide a first pixel voltage R+ to the first sub pixel 111; the second data line D2 is configured to provide a second pixel voltage R− to the second sub pixel 112; the third data line D3 is configured to provide a third pixel voltage B+ to the third sub pixel 113; the fourth data line D4 is configured to provide a fourth pixel voltage G+ to the fourth sub pixel 114; the fifth data line D5 is configured to provide a fifth pixel voltage B− to the fifth sub pixel 115; and the sixth data line D6 is configured to provide a sixth pixel voltage G− to the sixth sub pixel 116.

In some embodiments, the polarities of the first pixel voltage R+ and the second pixel voltage R− are different; the polarities of the third pixel voltage B+ and the fourth pixel voltage G+ are the same; the polarities of the fifth pixel voltage B− and the sixth pixel voltage G− are the same. For example, the first pixel voltage R+ is positive but the second pixel voltage R− is negative, the third pixel voltage B+ and the fourth pixel voltage G+ are both positive, and the fifth pixel voltage B− and the sixth pixel voltage G− are both negative.

In some embodiments, a first switch SW1 is coupled to the first data line D1, a second switch SW2 is coupled to the second data line D2, a third switch SW3 is coupled to the third data line D3, a fourth switch SW4 is coupled to the fourth data line D4, a fifth switch SW5 is coupled to the fifth data line D5, and a sixth switch SW6 is coupled to the sixth data line D6.

In some embodiments, the third switch SW3, the fourth switch SW4, and the first switch SW1 are included in a first multiplexer, and the first multiplexer is configured to receive a first data signal Y1+, a first switching signal SW_R, a second switching signal SW_G, and a third switching signal SW_B. In some embodiments, a seventh switch SW7, the second switch SW2, and the fifth switch SW5 are included in a second multiplexer, and the second multiplexer is configured to receive a second data signal Y2−, the first switching signal SW_R, the second switching signal SW_G, and the third switching signal SW_B. In some embodiments, a tenth switch SW10, an eleventh switch SW11, and a twelfth switch SW12 are included in a third multiplexer, and the third multiplexer is configured to receive a third data signal Y3+, the first switching signal SW_R, the second switching signal SW_G, and the third switching signal SW_B. In some embodiments, the sixth switch SW6, an eighth switch SW8, and a ninth switch SW9 are included in a fourth multiplexer, and the fourth multiplexer is configured to receive a fourth data signal Y4−, the first switching signal SW_R, the second switching signal SW_G, and the third switching signal SW_B.

In some embodiments, the first multiplexer, the second multiplexer, the third multiplexer, and the fourth multiplexer are included in a multiplexer combination 120, and the first data signal Y1+, the second data signal Y2−, the third data signal Y3+, and the fourth data signal Y4− are from a source driver.

In some embodiments, the first switch SW1, the second switch SW2, the twelfth switch SW12, and the eighth switch SW8 are opened or closed according to the first switching signal SW_R. The seventh switch SW7, the fourth switch SW4, the sixth switch SW6, and the eleventh switch SW11 are opened or closed according to the second switching signal SW_G. The third switch SW3, the fifth switch SW5, the tenth switch SW10, and the ninth switch SW9 are opened or closed according to the third switching signal SW_B.

Figure 2:
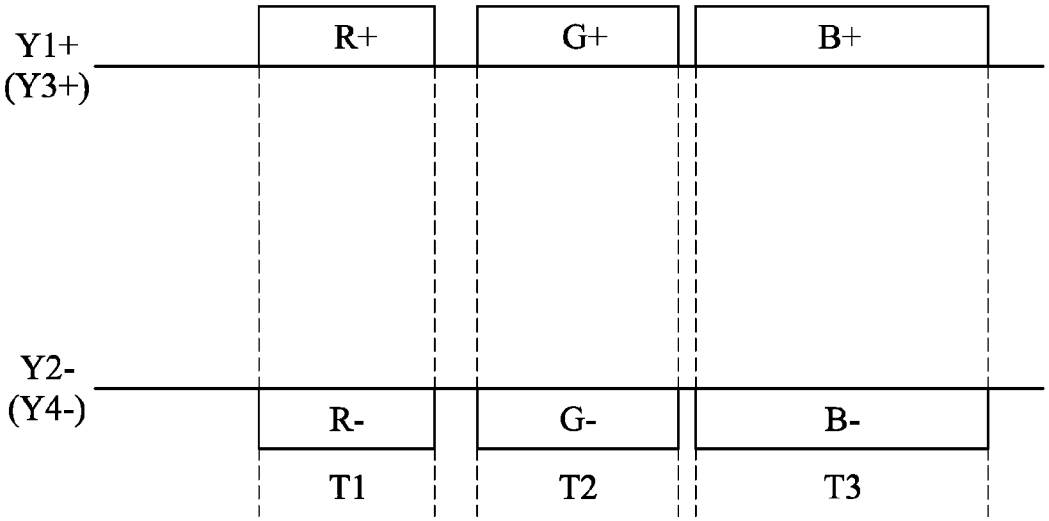
FIG. 2 is a schematic diagram of a data signal in FIG. 1 according to some embodiments of the present disclosure.
Figure 3:
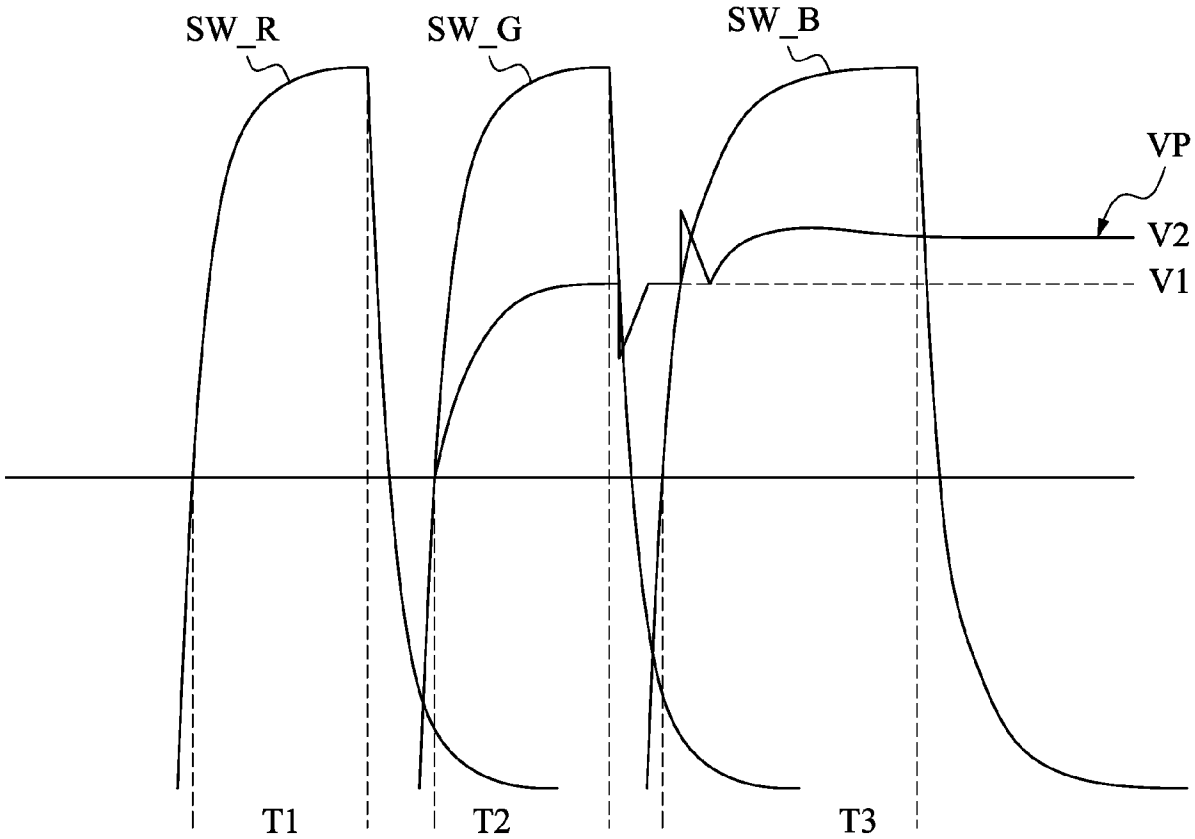
FIG. 3 is a waveform diagram of a switching signal in FIG. 1 according to some embodiments of the present disclosure.

Refer to FIG. 2 and FIG. 3. FIG. 2 is a schematic diagram of the first data signal Y1+, the second data signal Y2−, the third data signal Y3+, and the fourth data signal Y4− in FIG. 1 according to some embodiments of the present disclosure. FIG. 3 is a waveform diagram of the first switching signal SW_R, the second switching signal SW_G, and the third switching signal SW_B in FIG. 1 according to some embodiments of the present disclosure.

In some embodiments, the first data signal Y1+ includes the first pixel voltage R+, the fourth pixel voltage G+, and the third pixel voltage B+. The second data signal Y2− includes the second pixel voltage R−, the sixth pixel voltage G−, and the fifth pixel voltage B−. At a first time T1, the first data signal Y1+ is the first pixel voltage R+, and the second data signal Y1− is the second pixel voltage R−. At a second time T2, the first data signal Y1+ is the fourth pixel voltage G+, and the second data signal Y1− is the sixth pixel voltage G−. At a third time T3, the first data signal Y1+ is the third pixel voltage B+, and the second data signal Y1− is the fifth pixel voltage B−.

In some embodiments, the third data signal Y3+ is similar to the first data signal Y1+, and the fourth data signal Y4− is similar to the second data signal Y2−. Therefore, details are not provided herein.

In some embodiments, at the first time T1, when the first switch SW1 is opened according to the first switching signal SW_R, the first data line D1 transmits the first pixel voltage R+ of the first data signal Y1+ to the first sub pixel 111. When the second switch SW2 is opened according to the first switching signal SW_R, the second data line D2 transmits the second pixel voltage R− of the second data signal Y2− to the second sub pixel 112. Equivalently, the first data line D1 and the second data line D2 respectively provide the first pixel voltage R+ and the second pixel voltage R− to the first sub pixel 111 and the second sub pixel 112 at the first time T1.

Although the first data line D1 and the second data line D2 form a near line configuration, and the polarities of the first pixel voltage R+ and second pixel voltage R− are different, because the first pixel voltage R+ and the second pixel voltage R− correspond to a same color, the first pixel voltage R+ and the second pixel voltage R− are both provided at the first time T1. In this case, impact of coupling between the first pixel voltage R+ and the second pixel voltage R− is reduced, and this is advantageous to display effects of the display device 100.

In some embodiments, at the second time T2, when the fourth switch SW4 is opened according to the second switching signal SW_G, the fourth data line D4 transmits the fourth pixel voltage G+ of the first data signal Y1+ to the fourth sub pixel 114. When the sixth switch SW6 is opened according to the second switching signal SW_G, the sixth data line D6 transmits the sixth pixel voltage G− of the fourth data signal Y4− to the sixth sub pixel 116. Equivalently, the fourth data line D4 and the sixth data line D6 respectively provide the fourth pixel voltage G+ and the sixth pixel voltage G− to the fourth sub pixel 114 and the sixth sub pixel 116 at the second time T2.

In some embodiments, at the third time T3, when the third switch SW3 is opened according to the third switching signal SW_B, the third data line D3 transmits the third pixel voltage B+ of the first data signal Y1+ to the third sub pixel 113. When the fifth switch SW5 is opened according to the third switching signal SW_B, the fifth data line D5 transmits the fifth pixel voltage B− of the second data signal Y2− to the fifth sub pixel 115. Equivalently, the third data line D3 and the fifth data line D5 respectively provide the third pixel voltage B+ and the fifth pixel voltage B− to the third sub pixel 113 and the fifth sub pixel 115 at the third time T3.

Although the third data line D3 and the fourth data line D4 form a near line configuration, because the third pixel voltage B+ and the fourth pixel voltage G+ have same polarities (for example, positive polarities), the third pixel voltage B+ and the fourth pixel voltage G+ are relatively not affected by each other to be coupled to abnormal levels. For example, assuming that the fourth pixel voltage has a positive polarity but the third pixel voltage has a negative polarity, the fourth pixel voltage may be pulled down by the third pixel voltage to an abnormal level.

As shown in FIG. 3, in some embodiments, a pixel voltage VP represents a waveform of the fourth pixel voltage G+. At the second time T2, when the fourth switch SW4 is opened according to the second switching signal SW_G, the fourth pixel voltage G+ is transmitted to the fourth data line D4 by using the fourth switch SW4. In this case, the fourth pixel voltage G+ rises to a first voltage V1. Then, at the third time T3, when the third switch SW3 is opened according to the third switching signal SW_B, the third pixel voltage B+ is transmitted to the third data line D3 by using the third switch SW3. In this case, the fourth pixel voltage G+ on the fourth data line D4 is affected by the third pixel voltage B+ on the third data line D3 and rises to a voltage V2. Because the fourth pixel voltage G+ having a positive polarity is coupled to a higher voltage level (still positive), operation of the display device 100 is not affected.

Similarly, although the fifth data line D5 and the sixth data line D6 form a near line configuration, because the fifth pixel voltage B− and the sixth pixel voltage G− have same polarities (for example, negative polarities), the fifth pixel voltage B− and the sixth pixel voltage G− are relatively not affected by each other to be coupled to abnormal levels. For example, assuming that the sixth pixel voltage has a negative polarity but the fifth pixel voltage has a positive polarity, the sixth pixel voltage may be pulled up by the fifth pixel voltage to an abnormal level.

Figure 4:
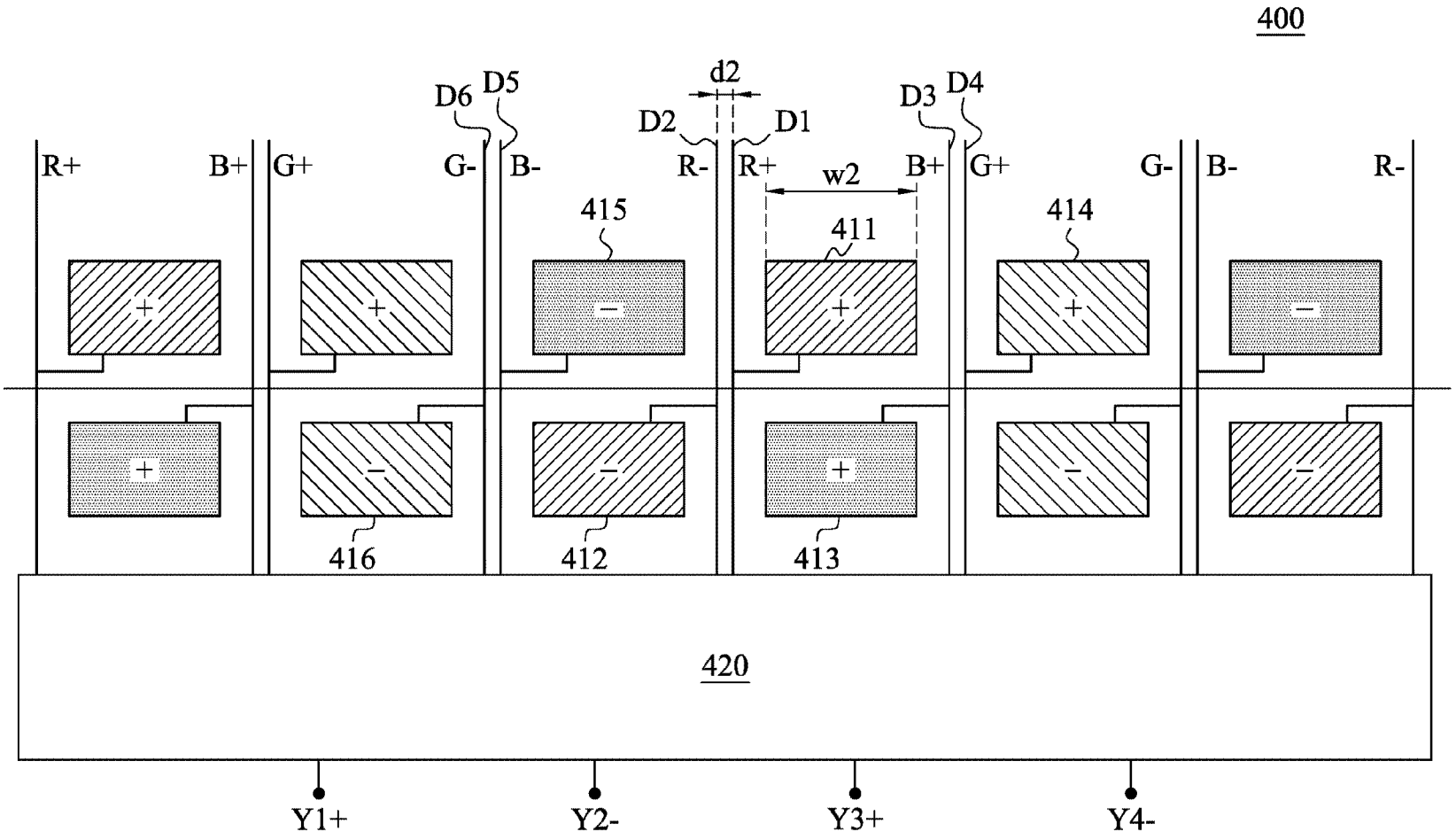
FIG. 4 is a part of a schematic diagram of a display device according to some embodiments of the present disclosure.

Refer to FIG. 4. FIG. 4 is a part of a schematic diagram of a display device 400 according to some embodiments of the present disclosure. In some embodiments, the display device 400 includes a multiplexer combination 420. In some embodiments, the multiplexer combination 420 in FIG. 4 is similar to the multiplexer combination 120 in FIG. 1, and thus is not described in detail herein. Descriptions are provided below specific to only main differences between FIG. 4 and FIG. 1. Refer to the foregoing embodiments for remaining parts.

Any sub pixel in FIG. 4 is disposed between two data lines. For example, a first sub pixel 411 in FIG. 4 is disposed between a first data line D1 and a third data line D3. Compared with this, any sub pixel in FIG. 1 is disposed between another sub pixel and a data line. For example, the first sub pixel 111 in FIG. 1 is disposed between a fourth data line D4 and the fourth sub pixel 114.

Using FIG. 4 as an example, the first data line D1 and a second data line D2 are disposed between the first sub pixel 411 and a fifth sub pixel 415 and are disposed between a second sub pixel 412 and a third sub pixel 413; the first sub pixel 411 is adjacent to a fifth sub pixel 415, and the second sub pixel 412 is adjacent to the third sub pixel 413. In this way, the first data line D1 and the second data line D2 form a near line configuration. In addition, the third data line D3 and the fourth data line D4 are disposed between the first sub pixel 411 and a fourth sub pixel 414, and the first sub pixel 411 is adjacent to the fourth sub pixel 414. In this way, the third data line D3 and the fourth data line D4 form a near line configuration. A fifth data line D5 and a sixth data line D6 are disposed between a sixth sub pixel 416 and the second sub pixel 412, and the sixth sub pixel 416 is adjacent to the second sub pixel 412. In this way, the fifth data line D5 and the sixth data line D6 form a near line configuration.

As stated in the foregoing embodiments, although the first data line D1 and the second data line D2 form a near line configuration, and the polarities of the first pixel voltage R+ and second pixel voltage R− are different, the first pixel voltage R+ and the second pixel voltage R− correspond to a same color, and the first pixel voltage R+ and the second pixel voltage R− are both provided at the first time T1. In this case, impact of coupling between the first pixel voltage R+ and second pixel voltage R− is reduced. In addition, although the third data line D3 and the fourth data line D4 form a near line configuration, because the third pixel voltage B+ and the fourth pixel voltage G+ have same polarities (for example, positive polarities), the third pixel voltage B+ and the fourth pixel voltage G+ are relatively not affected by each other to be coupled to abnormal levels. Moreover, although the fifth data line D5 and the sixth data line D6 form a near line configuration, because the fifth pixel voltage B− and the sixth pixel voltage G− have same polarities (for example, negative polarities), the fifth pixel voltage B− and the sixth pixel voltage G− are relatively not affected by each other to be coupled to abnormal levels.

In some embodiments, a distance between any two data lines is smaller than a pixel width of any sub pixel. For example, a distance d2 between the first data line D1 and the second data line D2 is smaller than a pixel width w2 of the first sub pixel 411. In some embodiments, pixel widths of all sub pixels are the same. In some other embodiments, pixel widths of all sub pixels are different or partially different.

Figure 5:
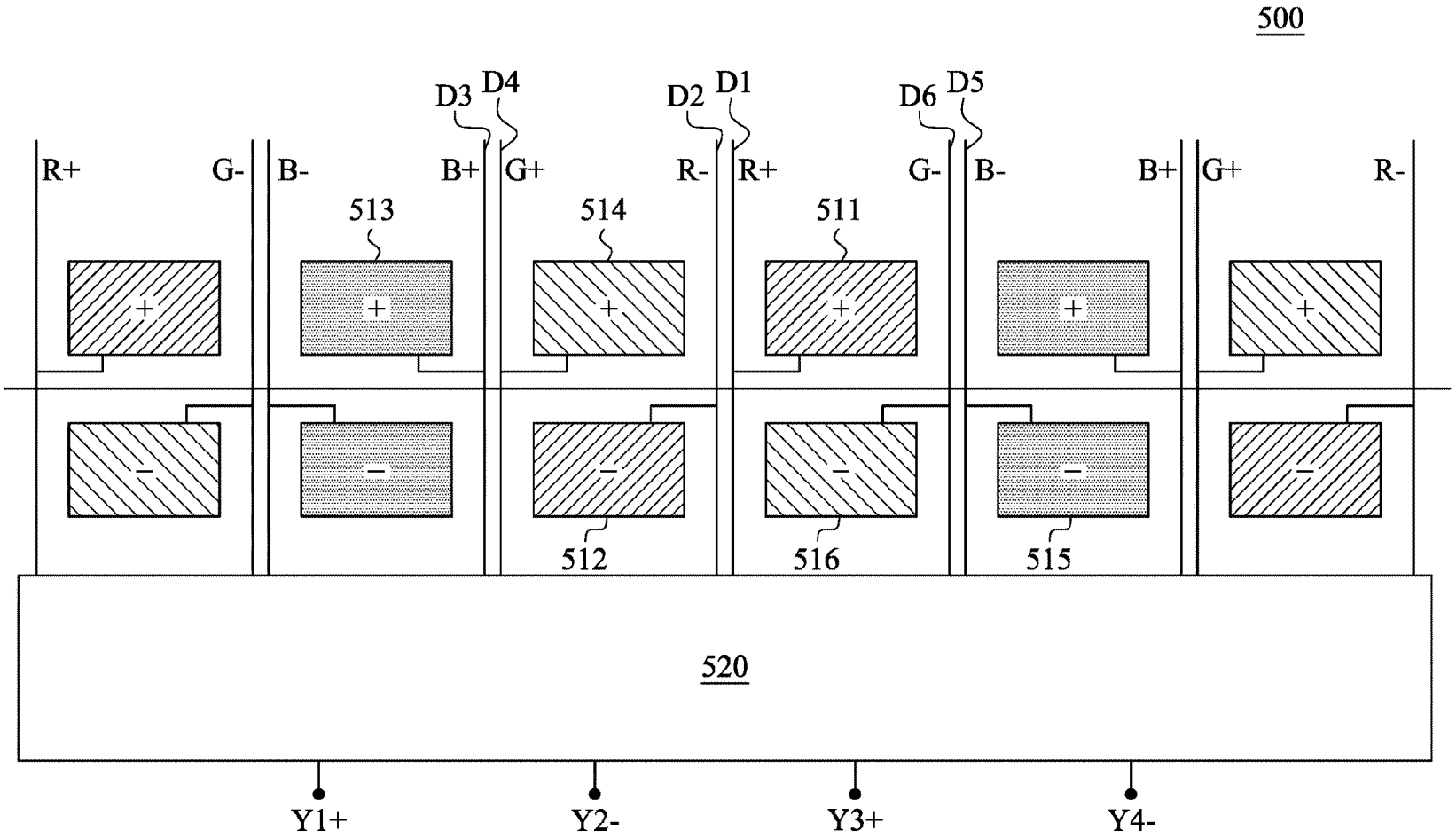
FIG. 5 is a part of a schematic diagram of a display device according to some embodiments of the present disclosure.

Refer to FIG. 5. FIG. 5 is a part of a schematic diagram of a display device 500 according to some embodiments of the present disclosure. In some embodiments, the display device 500 includes a multiplexer combination 520. In some embodiments, the multiplexer combination 520 in FIG. 5 is similar to the multiplexer combination 420 in FIG. 4. Descriptions are provided below specific to only main differences between FIG. 5 and FIG. 4. Refer to the foregoing embodiments for remaining parts.

Using FIG. 5 as an example, a first data line D1 and a second data line D2 are disposed between a first sub pixel 511 and a fourth sub pixel 514 and are disposed between a second sub pixel 512 and a sixth sub pixel 516; the first sub pixel 511 is adjacent to the fourth sub pixel 514, and the second sub pixel 512 is adjacent to the sixth sub pixel 516. In this way, the first data line D1 and the second data line D2 form a near line configuration. In addition, a third data line D3 and a fourth data line D4 are disposed between the third sub pixel 513 and the fourth sub pixel 514, and the third sub pixel 513 is adjacent to the fourth sub pixel 514. In this way, the third data line D3 and the fourth data line D4 form a near line configuration. A fifth data line D5 and a sixth data line D6 are disposed between the sixth sub pixel 516 and the fifth sub pixel 515, and the sixth sub pixel 516 is adjacent to the fifth sub pixel 515. In this way, the fifth data line D5 and the sixth data line D6 form a near line configuration.

Figure 6:
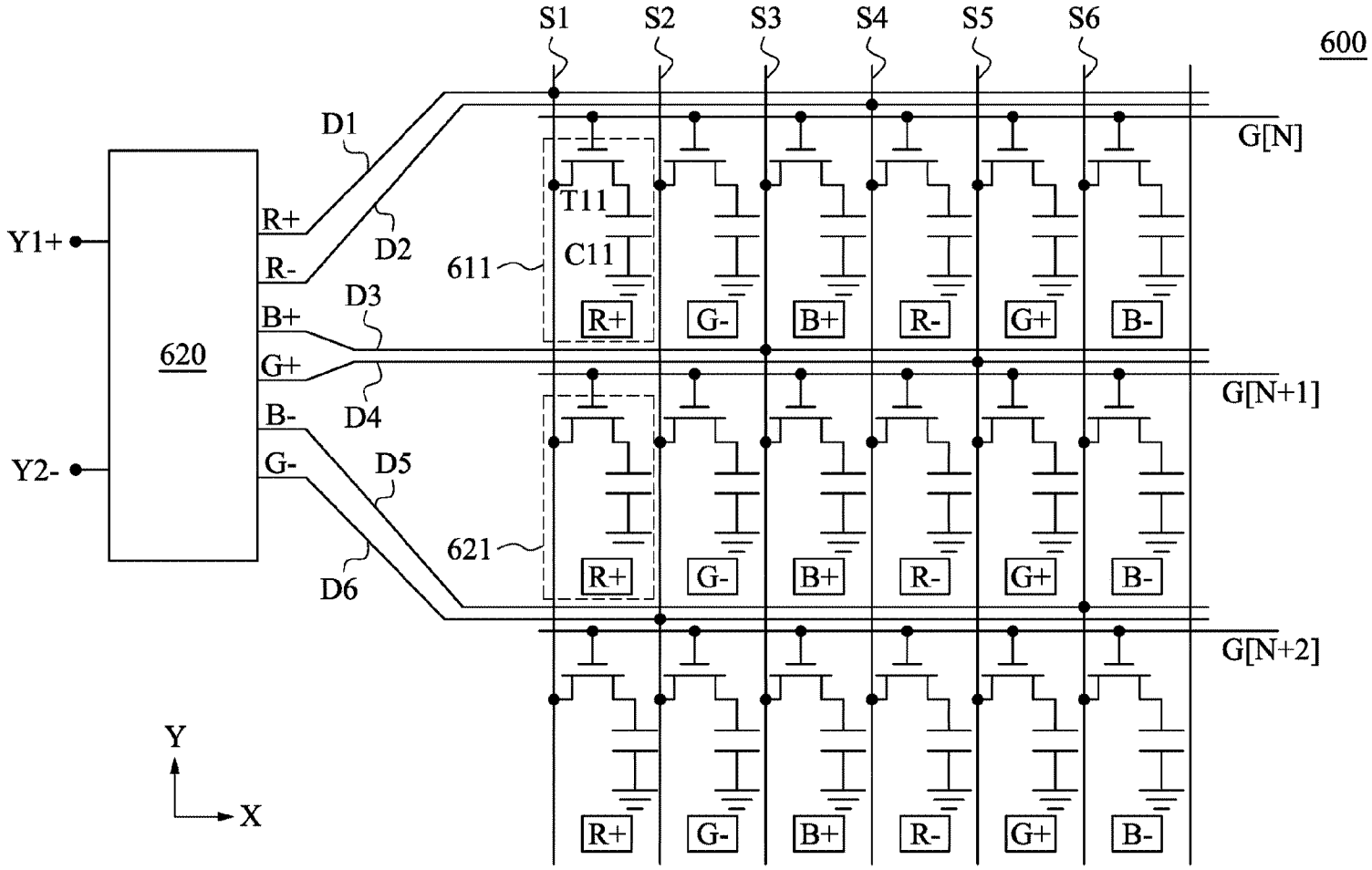
FIG. 6 is a part of a schematic diagram of a display device according to some embodiments of the present disclosure.

Refer to FIG. 6. FIG. 6 is a part of a schematic diagram of a display device 600 according to some embodiments of the present disclosure. In some embodiments, the display device 600 includes a multiplexer combination 620, and the multiplexer combination 620 includes two multiplexers. One multiplexer respectively transmits the first pixel voltage R+, the third pixel voltage B+, and the fourth pixel voltage G+ of the first data signal Y1+ to a first data line D1, a third data line D3, and a fourth data line D4, and the other multiplexer respectively transmits the second pixel voltage R−, the fifth pixel voltage B−, and the sixth pixel voltage G− of the second data signal Y2− to a second data line D2, a fifth data line D5, and a sixth data line D6.

In some embodiments, the display device 600 further includes a first signal line S1. The first signal line S1 is coupled to the first data line D1 and a sub pixel in a first column. In some embodiments, the first signal line S1 is disposed perpendicular to a part of the first data line D1. The first signal line S1 receives the first pixel voltage R+ from the first data line D1, and transmits the first pixel voltage R+ to the sub pixel disposed in the first column.

In some embodiments, the display device 600 further includes a second signal line S2. The second signal line S2 is coupled to the sixth data line D6 and a sub pixel in a second column. In some embodiments, the second signal line S2 is disposed perpendicular to a part of the sixth data line D6. The second signal line S2 receives the sixth pixel voltage G− from the sixth data line D6, and transmits the sixth pixel voltage G− to the sub pixel disposed in the second column.

In some embodiments, the display device 600 further includes a third signal line S3. The third signal line S3 is coupled to the third data line D3 and a sub pixel in a third column. In some embodiments, the third signal line S3 is disposed perpendicular to a part of the third data line D3. The third signal line S3 receives the third pixel voltage B+ from the third data line D3, and transmits the third pixel voltage B+ to the sub pixel disposed in the third column.

In some embodiments, the display device 600 further includes a fourth signal line S4. The fourth signal line S4 is coupled to the second data line D2 and a sub pixel in a fourth column. In some embodiments, the fourth signal line S4 is disposed perpendicular to a part of the second data line D2. The fourth signal line S4 receives the second pixel voltage R− from the second data line D2, and transmits the second pixel voltage R− to the sub pixel disposed in the fourth column.

In some embodiments, the display device 600 further includes a fifth signal line S5. The fifth signal line S5 is coupled to the fourth data line D4 and a sub pixel in a fifth column. In some embodiments, the fifth signal line S5 is disposed perpendicular to a part of the fourth data line D4. The fifth signal line S5 receives the fourth pixel voltage G+ from the fourth data line D4, and transmits the fourth pixel voltage G+ to the sub pixel disposed in the fifth column.

In some embodiments, the display device 600 further includes a sixth signal line S6. The sixth signal line S6 is coupled to the fifth data line D5 and a sub pixel in a sixth column. In some embodiments, the sixth signal line S6 is disposed perpendicular to a part of the fifth data line D5. The sixth signal line S6 receives the fifth pixel voltage B− from the fifth data line D5, and transmits the fifth pixel voltage B− to the sub pixel disposed in the sixth column.

In some embodiments, sub pixels in a first row, a second row, and a third row respectively receive gate drive signals G[N], G[N+1], and G[N+2], so that drive transistors in the sub pixels are conducted. Then, the sub pixels are correspondingly displayed according to the received pixel voltages. For example, a drive transistor T11 of a sub pixel 611 is conducted according to the gate drive signal G[N], and the first pixel voltage R+ is transmitted to the drive transistor T11 by using the first data line D1 and the first signal line S1. When the drive transistor T11 is conducted, the first pixel voltage R+ charges a capacitor C11 by using the drive transistor T11. Other sub pixels have similar operations and thus are not described in detail herein.

As shown in FIG. 6, the third data line D3 and the fourth data line D4 are disposed between the sub pixel 611 and a sub pixel 621, and the sub pixel 611 is adjacent to the sub pixel 621. In this way, the third data line D3 and the fourth data line D4 form a near line configuration. Similarly, the first data line D1 and the second data line D2 also form a near line configuration, and the fifth data line D5 and the sixth data line D6 also form a near line configuration.

As stated in the foregoing embodiments, although the first data line D1 and the second data line D2 form a near line configuration, and the polarities of the first pixel voltage R+ and second pixel voltage R− are different, the first pixel voltage R+ and the second pixel voltage R− correspond to a same color, and the first pixel voltage R+ and the second pixel voltage R− are both provided at the first time T1. In this case, impact of coupling between the first pixel voltage R+ and second pixel voltage R− is reduced. In addition, although the third data line D3 and the fourth data line D4 form a near line configuration, because the third pixel voltage B+ and the fourth pixel voltage G+ have same polarities (for example, positive polarities), the third pixel voltage B+ and the fourth pixel voltage G+ are relatively not affected by each other to be coupled to abnormal levels. Moreover, although the fifth data line D5 and the sixth data line D6 form a near line configuration, because the fifth pixel voltage B− and the sixth pixel voltage G− have same polarities (for example, negative polarities), the fifth pixel voltage B− and the sixth pixel voltage G− are relatively not affected by each other to be coupled to abnormal levels.

In some embodiments, the data lines in FIG. 6 extend along a first direction X, and the signal lines in FIG. 6 extend along a second direction Y. In some embodiments, the first direction X is perpendicular to the second direction Y. Compared with this, the data lines in FIG. 1 extend along the second direction Y.

Figure 7:
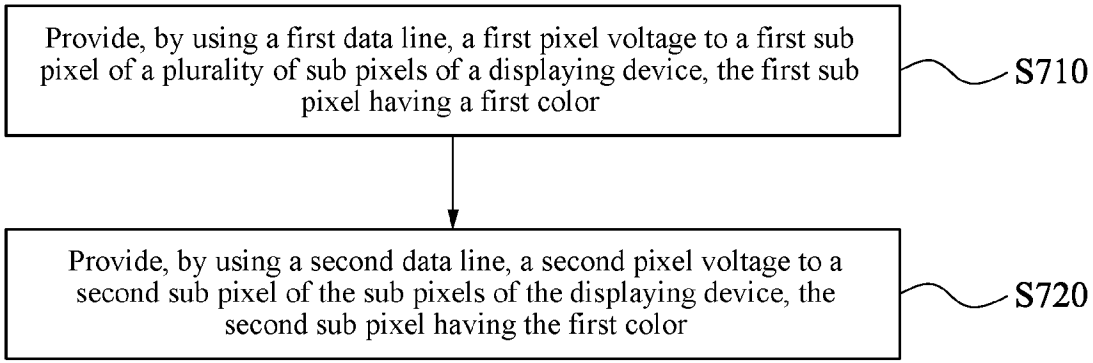
FIG. 7 is a flowchart of a driving method for a display device according to some embodiments of the present disclosure.

Refer to FIG. 7. FIG. 7 is a flowchart of a driving method 700 for a display device according to some embodiments of the present disclosure. In some embodiments, the driving method 700 includes step S710 and step S720. To understand content of the present disclosure in a preferred manner, the driving method 700 is discussed with reference to the display device 100 in FIG. 1, but the content of the present disclosure is not limited thereto.

Step S710: Provide, by using a first data line D1, a first pixel voltage R+ to a first sub pixel 111 of a plurality of sub pixels of the display device 100, the first sub pixel 111 having a first color. In some embodiments, the first color is red, but the content of the present disclosure is not limited thereto. In some other embodiments, the first color may be green or blue.

Step S720: Provide, by using a second data line D2, a second pixel voltage R− to a second sub pixel 112 of the sub pixels of the display device 100, the second sub pixel 112 having the first color. The first data line D1 and the second data line D2 are disposed between two adjacent sub pixels. Using FIG. 1 as an example, the first data line D1 and the second data line D2 are disposed between the fourth sub pixel 114 and the fifth sub pixel 115. In this way, the first data line D1 and the second data line D2 form a near line configuration. Although the first data line D1 and the second data line D2 form a near line configuration, the first pixel voltage R+ and the second pixel voltage R− correspond to a same color, and the first pixel voltage R+ and the second pixel voltage R− are simultaneously provided. In this case, impact of coupling between the first pixel voltage R+ and second pixel voltage R− is reduced.

The driving method 700 in the foregoing statement includes exemplary operations, but these operations are not necessarily performed according to the foregoing order. According to the spirit and scope of the content of the present disclosure, the order of operations in the driving method 700 in the content of the present disclosure can be changed, or the operations can be simultaneously or partially simultaneously performed according to a condition.

Based on the above, by means of any one of the foregoing embodiments, it can be avoided that the first pixel voltage on the first data line is coupled by the second pixel voltage on the second data line to an abnormal level.

Although the present disclosure is disclosed above by the foregoing implementations, these embodiments are not intended to limit the present disclosure. Various changes and modifications can be made by persons of ordinary skill in the art without departing from the spirit and scope of the present disclosure. Therefore, the protection scope of the present disclosure should be subject to the appended claims.

What is claimed is:

1. A display device, comprising:

a plurality of sub pixels;

a first data line, configured to provide a first pixel voltage to a first sub pixel of the sub pixels, the first sub pixel having a first color;

a second data line, configured to provide a second pixel voltage to a second sub pixel of the sub pixels, the second sub pixel having the first color, wherein the first data line and the second data line are disposed between two adjacent sub pixels of the sub pixels, and the first data line and the second data line respectively provide the first pixel voltage and the second pixel voltage at a first time;

a third data line, configured to provide a third pixel voltage to a third sub pixel of the sub pixels, the third sub pixel having a second color; and a fourth data line, configured to provide a fourth pixel voltage to a fourth sub pixel of the sub pixels, the fourth sub pixel having a third color, wherein the third data line and the fourth data line are disposed between two adjacent sub pixels of the sub pixels;

wherein polarities of the first pixel voltage and the second pixel voltage are different, and polarities of the third pixel voltage and the fourth pixel voltage are the same.

2. The display device according to claim 1, further comprising:

a fifth data line, configured to provide a fifth pixel voltage to a fifth sub pixel of the sub pixels, the fifth sub pixel having the second color; and a sixth data line, configured to provide a sixth pixel voltage to a sixth sub pixel of the sub pixels, the sixth sub pixel having the third color, wherein the fifth data line and the sixth data line are disposed between two adjacent sub pixels of the sub pixels; and polarities of the fifth pixel voltage and the sixth pixel voltage are the same.

3. The display device according to claim 2, wherein the fourth data line and the sixth data line respectively provide the fourth pixel voltage and the sixth pixel voltage at a second time, and the third data line and the fifth data line respectively provide the third pixel voltage and the fifth pixel voltage at a third time.

4. The display device according to claim 1, wherein a distance between the first data line and the second data line is smaller than a pixel width of any one of the sub pixels.

5. A driving method for a display device, comprising:

providing, by using a first data line, a first pixel voltage to a first sub pixel of a plurality of sub pixels of the display device, the first sub pixel having a first color;

providing, by using a second data line, a second pixel voltage to a second sub pixel of the sub pixels of the display device, the second sub pixel having the first color, wherein the first pixel voltage and the second pixel voltage are provided to the first sub-pixel and the second sub-pixel at a first time;

providing, by using a third data line, a third pixel voltage to a third sub pixel of the sub pixels of the display device, the third sub pixel having a second color; and providing, by using a fourth data line, a fourth pixel voltage to a fourth sub pixel of the sub pixels of the display device, the fourth sub pixel having a third color;

wherein the first data line and the second data line are disposed between two adjacent sub pixels of the sub pixels, the third data line and the fourth data line are disposed between two adjacent sub pixels of the sub pixels, the polarities of the first pixel voltage and the second pixel voltage are different, and the polarities of the third pixel voltage and the fourth pixel voltage are the same.

6. The driving method according to claim 5, further comprising:

providing, by using a fifth data line, a fifth pixel voltage to a fifth sub pixel of the sub pixels of the display device, the fifth sub pixel having the second color; and providing, by using a sixth data line, a sixth pixel voltage to a sixth sub pixel of the sub pixels of the display device, the sixth sub pixel having the third color, wherein the fifth data line and the sixth data line are disposed between two adjacent sub pixels of the sub pixels, and the polarities of the fifth pixel voltage and the sixth pixel voltage are the same.

7. The driving method according to claim 6, wherein the fourth data line and the sixth data line provide the fourth pixel voltage and the sixth pixel voltage at a second time, and the third data line and the fifth data line provide the third pixel voltage and the fifth pixel voltage at a third time.

* * * * *